US005242480A

United States Patent [19]

Rebière et al.

[11] Patent Number: 5,242,480

[45] Date of Patent: Sep. 7, 1993

[54] DESULFURIZING AGENT FOR CAST IRON, COMPRISING CALCIUM CARBIDE AND AN ORGANIC BINDING AGENT

[75] Inventors: Michel Rebière, Le Fayet; Gilles Nussbaum, Passy, both of France

[73] Assignee: Pechiney Electrometallurgie, Courbevoie, France

[21] Appl. No.: 862,527

[22] Filed: Apr. 2, 1992

[30] Foreign Application Priority Data

Apr. 2, 1991 [FR] France ..... 91 04452
Jul. 18, 1991 [FR] France ..... 91 09557

[51] Int. Cl.[5] ..... C21C 7/02
[52] U.S. Cl. ..... 75/312
[58] Field of Search ..... 75/312

[56] References Cited

U.S. PATENT DOCUMENTS 2,863,755 12/1958 Kurzinski ..... 75/53
4,078,915 3/1978 Meichsner ..... 75/312
4,159,906 7/1979 Meichsner ..... 75/312
4,533,572 8/1985 Neelameggham et al. ..... 427/216

FOREIGN PATENT DOCUMENTS 0005124 10/1979 European Pat. Off. .
0184723 6/1986 European Pat. Off. .
0279894 8/1988 European Pat. Off. .

OTHER PUBLICATIONS

Abstract Japan, vol. 4, No. 46 (C-006), Apr. 10, 1980; JP-A-55 018 527 (Ibiden Co., Ltd) Aug. 2, 1990 Resume.
Abstract Japan vol. 14, No. 417 (C-756), Sep. 10, 1990; JP-A-2 160 658 (Mitsubishi Mining & Cement Co.) Jun. 6, 20, 1990 Resume.
Abstract Japan, vol. 3, No. 147 (C-0666), Dec. 5, 1979; JP-A-54 125 116 (Toyo Soda Mfg. Co., Ltd) Sep. 28, 1979 Resume.
Abstract Japan vol. 7, No. 281 (C-200), Dec. 15, 1983; JP-A-58 161 717 (Denki Kagaku Kogyo D.D.) Sep. 26, 1983 Resume.
Abstract Japan, vol. 9, No. 5, (C-260), Jan. 10, 1985; JP-A-59 159 909 (Yahashi Kogyo K.K.) Sep. 10, 1984 resume.
EP-A-0 360 223 (SKW Trostberg) DE-A-3 831 831 (Cat. D).
Abstract EP-A-0 220 522 (Hoechst AG).
FR-A-1 194 778 (Union Carbide Corp.).
FR-A-2 280 710 (Uniroyal Inc.).
EP-A-0 164 592 (Thyssen Stahl AG).

*Primary Examiner*—Peter D. Rosenberg
*Attorney, Agent, or Firm*—Pollock, Vande Sande & Priddy

[57] ABSTRACT

Product for desulfurization of liquid cast iron composed of technical calcium carbide powder, to which may be added products intended to cause gaseous release in the bath and to modify the composition of the slag and which is coated or agglomerated either by resins or an organic compound having a clear-cut melting point and which is solid at ambient temperature. The process comprises mixing of the carbide and additives with the binding agent, resin, or organic product, agglomeration by pellet formation, compression or extrusion, and possible second grinding and sifting to obtain the desired granulometry. The product is added to the liquid cast iron using a lance, by gravity, or as a filled wire. It has good pourability, increased effectiveness, and reduced reactivity to moisture. It is used for desulfurization of both forge and foundry pig iron.

28 Claims, 1 Drawing Sheet

DESULFURIZING AGENT FOR CAST IRON, COMPRISING CALCIUM CARBIDE AND AN ORGANIC BINDING AGENT

FIELD OF THE INVENTION

The technical field of the invention is the desulfurization of cast irons, whether they are forge pig iron intended for the manufacture of steel, or foundry pig iron intended, in particular, for the manufacture of spherulitic graphite iron. In the first instance, the sulfur content must be lowered to 0.005–0.010%; in the second, spheroidizing is possible only for sulfur contents of less than 0.010%.

BACKGROUND OF THE INVENTION

Most desulfurization agents are based on two alkaline earths, i.e., magnesium and calcium, which easily combine with sulfur to yield sulfides, while forming insoluble slag in the cast iron. Excess magnesium is removed because of its high steam pressure at the processing temperature. The excess calcium compounds (lime, carbonate, or carbide) are removed in the slag. Thus, use is made, separately or in combination, of metallic magnesium, calcium carbonate, lime, lime diamide (mixture of calcium carbonate and carbon), and calcium carbide, to which may potentially be added products intended to improve the pourability of the mixture, or to release gases allowing the effective distribution of the desulfurizing agent in the liquid cast iron.

As regards forge pig iron, these desulfurizing agents are, in fact, injected in suspension in an inert supporting gas, most often by means of a blast pipe. When dealing with foundry pig irons, the grains of desulfurizing agent are simply poured into the ladle, the casting spout, or the bath.

The invention concerns both a new desulfurization product basically containing calcium carbide and a binding agent, and its manufacturing process.

PRIOR ART

French Patent No. 1 194 778 (Union Carbide Corporation) describes an oil treatment process of the calcium carbide prior to use as a desulfurizing agent. Oil in the proportion of from 0.25 to 4% of the weight of the carbide is vaporized on the carbide, which has a granulometry of between 0.074 and 1.168 mm and is heated to 150° C. This oil may be mineral (petroleum oil, gasoline, kerosene), vegetable (linseed oil), or animal (fish oil). Synthetic waxes or paraffins may also prove suitable.

German Patent No. DE 3 831 831 (SKW) describes a desulfurizing product composed of a mixture of magnesium and calcium carbide, both of which are coated with fine particles of a substance containing silica, and of an oleaginous wetting means. Manufacture of the product involves mixing, in a drum or tapered mixer, carbide and magnesium having a granulometry of between 0.1 and 3 mm with oil in the proportion of 0.5% of total weight and 2 to 10% of the silica-based product. The oil may be a high-viscosity vegetable oil, but also a silicone or mineral oil. The silica-based product, which has a granulometry of less than 0.01 mm, may, for example, be diatoms, bentonite, or ferrosilicon or calcium-silicon furnace dust.

European Patent Application No. EP 0 184 723 (Cyanamid Canada Inc.) describes a process for preparation of a calcium carbide-based desulfurizing agent, in which the calcium carbide, preliminarily crushed into fragments of from 1 to 2 inches in diameter (25 to 50 mm), is then pulverized in a ball grinder, for example, and an organic polar liquid is added before and during the grinding operation in the proportion of from 0.001 to 1%, and preferably from 0.01 to 0.05 %, of the weight of the carbide. The organic liquid may be a compound containing up to 10 carbon atoms and preferably an alcohol, an ester, a ketone, an ether, an aldehyde, or a halogenated alkane.

U.S. Pat. No. 4 533 572 (Neelameggham) describes a process in which metallic pellets, in particular magnesium and aluminum pellets, are coated by means of a mixture of a polymerizable oil using mechanical means, heated to polymerize the oil into a lacquer, and, finally, heated to a higher temperature in order to transform the lacquer at least partially into carbon. The coating may contain fine particles of at least one calcium compound. These carbon-coated granulates are used for desulfurization and deoxidation of steels.

THE PROBLEM POSED

Desulfurization of cast iron using calcium carbide poses a dilemma:

The desulfurization reaction occurs at the interface of the solid $CaC_2$ and the liquid cast iron. The rapidity of the reaction increases as the solid is increasingly split up. To promote the reaction speed and to prevent the presence in the slag of excess carbide which has not reacted, an attempt may be made to use the finest calcium carbide possible. Certain desulfurizing products may thus be based on micronized calcium carbide, in which the average size of the grains approaches 20 micrometers.

However, a fine granulometry gives rise to a number of difficulties:

risk of explosion due to increased reactivity in the presence of moisture;

lack of pourability;

and, if carbide is used in a mixture with magnesium possessing a higher granulometry, a risk of segregation during transport.

Thus, preference is sometimes given, in particular in iron casting foundry work, to carbide composed of coarser grains, i.e., from 300 μm to 10 mm, for example. The reaction of the carbide is then very incomplete, thus leading to high scrap consumption per 1,000 kg raw steel, i.e., of up to 20 kg per ton of cast iron instead of 3 kg/t using micronized carbide. Consequently, the use of coarse carbide is reserved for casting operations in which the quantities treated are smaller. In metallurgy, it would lead to the dumping on the slag pile scoriae containing high levels of calcium carbide which has not reacted, a phenomenon which would prove very harmful to the environment.

The problem posed is of the same kind as regards desulfurization of steelmaking pig irons and foundry pig irons; however, the product as adapted does not have precisely the same characteristics.

For forge pig irons, the need is for a product having a fairly fine granulometry which lends itself to pneumatic transport and which does not clog the injection lance, but which does not contain an excess of superfines, thereby facilitating pourability. As an example, 85% and more of grains in these products may range between 25 and 300 μm. Foundry pig irons require a product having coarser grains, e.g., of from 300 μm to 10 mm.

SUMMARY OF THE INVENTION

It is an object of the invention is to solve this problem by proposing a desulfurizing agent having the efficacy of micronized calcium carbide and the granulometries indicated above. This result is achieved by increasing the granulometry of the product, by coating or agglomerating the micronized calcium carbide with an well-chosen organic binding agent, which disappears in contact with the liquid cast iron while dispersing the carbide in the bath. The desulfurizing agent is thus self-dispersing.

This binding agent also has other functions:

It protects the carbide against oxidation and moisture. Especially when the carbide exists as fine particles, it can cause explosions in contact with air (powder explosions). Furthermore, as is well known, its reaction with water and moisture produces acetylene, a very inflammable gas.

While preserving at the temperature of the liquid cast iron the reactive properties of the finely-divided calcium carbide, it makes it possible to agglomerate a second time the finest parts or carbide powders resulting from the grinding operation.

Since this agent has a relatively high clear-cut melting point, it makes it possible to avoid the progressive softening of the product in contact with a high temperature, which would produce clogging in the devices used to store, handle, and distribute the desulfurizing product.

This product may be used for desulfurization of the cast iron under different conditions:

For forge pig iron, the product is injected in the finest possible form using a lance, either alone or by co-injection with another desulfurizing agent such as magnesium;

For foundry pig iron, the product is either placed in the casting spout or on the bottom of the ladle before the cast iron is poured, or it is simply poured downward into the cast iron, in all cases in its coarsest form;

For both for forge and for foundry pig iron, the product is packed inside a continuous metallic tube inserted gradually into the cast iron (filled wire).

The invention also extends to the manufacturing process for the desulfurizing product.

DESCRIPTION OF PREFERRED EMBODIMENT

Figure 1:
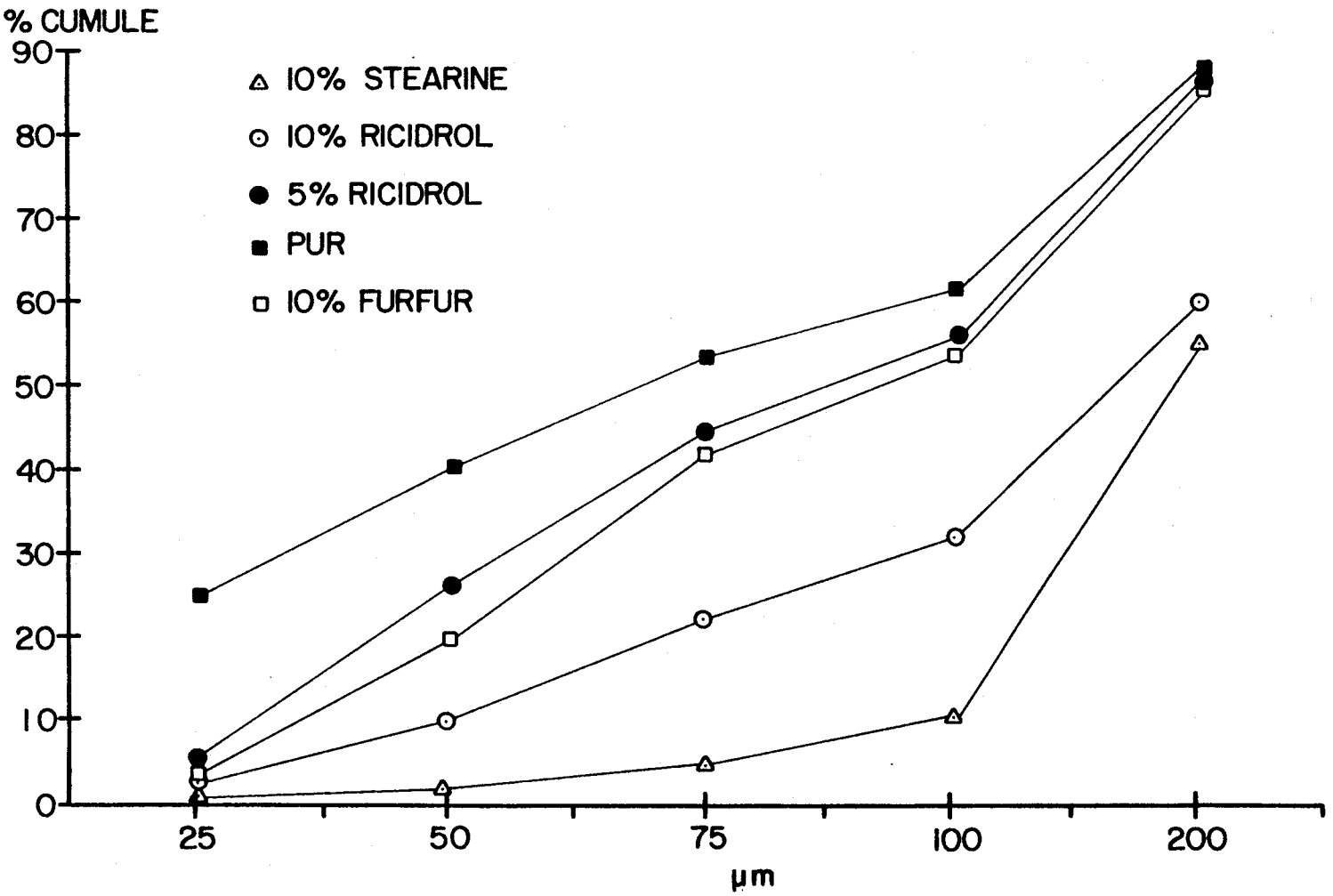

The calcium carbide-based product used for desulfurization of the liquid cast iron exists as grains composed of a calcium carbide powder coated or agglomerated using a binding agent composed of either an organic product whose melting point is between 70° C. and 100° C. or a polymer resin whose polymerization temperature is between 40° C. and 70° C.

Implementation of the invention involves two variants, depending on the application contemplated:

For the finest desulfurization agents intended for forge pig irons, implementation is limited to the first step described below. The calcium carbide is simply coated, i.e., formed from grains of calcium carbide coated with a first inner layer of a solid binding agent at ambient temperature, and, potentially, with a second, more or less continuous outer layer made of finer grains of calcium carbide, which are also coated. The percentage by weight of the grains ranging from 25 to 300 μm is at least 85%.

For the coarsest desulfurizing agents intended for foundry pig irons, the process is more complex, and comprises the three steps described below. The calcium carbide is agglomerated, i.e., formed from grains having a diameter of more than 0.3 mm, for example between 0.3 and 10 mm and composed of a micronized calcium carbide agglomerated using a binding agent. It is also possible, by intensifying the grinding process, to obtain a granulometry comparable to that of the coated carbide; however, this complicates the process needlessly.

"Calcium carbide" also signifies technical calcium carbide, which may contain from 10 to 15% or more of impurities, especially lime.

"Micronized calcium carbide" refers to powdered carbide in which all of the particles have a diameter of between several micrometers and 250 micrometers.

The process for manufacture of this desulfurizing agent comprises three steps: the first involves the preparation of a homogenous mixture of micronized calcium carbide and a binding agent composed either of an organic product having a melting point of between 70° C. and 100° C. or by a polymer resin whose polymerization temperature is between 40° C. and 70° C.; the second step involves the agglomeration of the mixture thus obtained; and the third, the secondary grinding of the agglomerated product so as to bring it down to the desired granulometry. As indicated above, the second and third steps are not always necessary and constitute a special embodiment of the invention.

Preparation of the Carbide-Binding Agent Mixture

Several kinds of products may be selected as binding agents:

binding agents which are solid at ambient temperature whose melting point, preferably clear-cut, is between 70° C. and 100° C. This temperature is slightly higher than that to which the desulfurizing agent might be exposed during storage, thereby preventing the grains from sticking to each other. It is on the order of magnitude of that which exists in the agglomeration equipment, thereby facilitating this operation.

To obtain a clear-cut melting point, advantage is gained by using a product composed of over 50% of a single chemical type, e.g., 80% or, even better, 90%.

Use is made of certain pitches, stearic acid, whose melting point is approximately 70° C., or fatty glycerol esters. A product marketed under the name RICIDROL obtained from hydrogenation of castor oil is particularly well suited. Castor oil contains more than 80% glycerol triricinoleate. Ricinoleic acid is an acid at $C_{18}$ a comprising a double bond and an alcohol function. Hydrogenation of the castor oil leads, by means of saturation of the double bond, to a product whose composition is more than 50% glycerol trihydroxystearate and which has a clear-cut melting point of 86° C. On the other hand, the paraffins, mixtures of saturated carbides, cannot be used, since softening of these begins at 40° C.

Fatty glycerol esters, and in particular, glycerol trihydroxystearate, are preferred for manufacture of the coated carbide.

Resins whose polymerization takes place at ambient or moderate temperature (from 40° C. to 70° C.), for example, include furfurylic, polyester, vinyl-ester, epoxy, resins, etc., this list not being restrictive.

While polymerizing during the agglomeration treatment, the resin hardens and makes it possible to prevent softening of the desulfurizing product during storage.

If use is made of binding agents other than resins (pitches, hydrogenated castor oil, stearic acid, etc.), the carbide-binding agent mixture can be prepared either preliminarily in a mixer or even in the carbide-reduction mill, which makes an excellent mixer, or directly in the unpressurized agglomeration apparatus, such as a drum agglomerator or an inclined pan. In both cases, the constituents of the mixture are generally heated to a temperature slightly higher than that of the liquefaction of the binding agent, so that the latter becomes liquid, but in such a way that, at the outlet of the agglomeration apparatus, the binding agent solidifies. This heating is indispensable when micronized carbide is used. Heating may be avoided by using a cylinder press, which has both a grinding and an agglomerating function and which can be fed directly with coarse carbide and binding agent at ambient temperature.

If, as binding agents, use is made of resins, e.g., furfurylic, polyester, vinyl-ester, or epoxy resins, mixture of carbide and binding agent occurs preliminarily at ambient temperature in a mixer or grinder. It is also possible to mix the resin and carbide at the top of the grinder used to micronize the carbide, and to add the polymerization catalyst to the mixer. The mixture is then placed in the agglomeration apparatus, where it may be lightly heated to accelerate polymerization of the resin.

It is also possible, within the scope of the invention, to add to the calcium carbide other additives intended to cause gaseous release in the cast iron bath: the additives include carbon-containing products (coal, anthracite, oil coke, etc.) in a proportion of from 4 to 10% of the weight of the carbide, and calcium carbonate and lime diamide in greater proportions; or to modify the composition of the slag: lime, aluminum oxide, magnesia; on to control the activity of the oxygen in the cast iron: carbon black, aluminum, magnesium, or calcium.

These additives, whose total may be approximately 100% of the weight of the carbide, are added either in the grinder or, in powder form, in a mixer after leaving the grinder.

The quantity of binding agent to be used is between 0.2 and 15% of the weight of the carbide or of the carbide-additives mixture, and preferably, between 0.2 and 10%.

Aglomeration of the Carbid-binding Agent Mixture

The agglomeration operation employs conventional techniques to be chosen as a function of the nature of the binding agent and of the size and mechanical properties of the agglomerated product whose manufacture is sought.

Two groups of techniques may be used:

a) mixing or unpressurized techniques. The apparatuses used include:

The granulating (or pelletizing) drum. This is a rotating cylinder inclined in relation to the horizontal by several degrees and driven by a variable-speed motor. The product to be agglomerated is placed in the upper end of the cylinder and the agglomerated product is removed at the lower end. The dimensions of the cylinder and its speed of rotation determine the retention time of the product, and, in consequence, its final granulometry. If required, after the product leaves the drum, it is sifted so remove particles which are either too fine or to coarse. After a second crushing operation, these latter are recycled to the top of the drum.

The inclined pan. This is a circular plate positioned in a plane inclined 30° to 65° to the horizontal and rotating around an axis perpendicular to this plane. The pan incorporates an edge on its circumference. The product to be agglomerated is fed to the center of the pan. The coarsest pellets travel upward and are carried away over the edge, at the lower part of the plate. As previously described, the agglomerated product is then sifted and the fine and coarse particles are ground again.

The drum agglomerator: The principle is fairly similar to that underlying the inclined pan. This is a truncated cone whose aperture angle is between 5 and 30°, open at its long base, and rotating around its substantially horizontal axis. The product to be agglomerated is placed toward the bottom of the truncated cone (on the short base side). The agglomerated product emerges at the long base in proximity to the lower generating line of the truncated cone. As in the previous instances, the agglomerated product is sifted and the fine and coarse particles are crushed again and recycled.

Other, more recent apparatuses, such as granulating mixers equipped with rotors.

b) Pressurized agglomeration techniques. The apparatuses used include:

The roll press comprising two cylinders whose axes are horizontal and which turn in opposite directions. These cylinders are substantially tangent or are separated by a small distance, and may incorporate cavities of various shapes, i.e., pellets, cushions, eggs, etc. In this instance, the preliminary hot grinding/mixing step may be avoided, and the press may be fed directly with coarse carbide of all sizes (from 0 to 12 mm) and with binding agent in the form of flakes, the press functioning like a cylinder grinder.

The tableting presses, which exists in several versions. The principle remains the same: a cavity whose shape matches that of the pellet to be manufactured is formed by a cylindrical mold having a vertical axis and whose lower part is sealed by a plunger. The powder is poured into this cavity, levelled, then compressed by the descent of an upper plunger adjusted to the desired rate of compression. After the upper plunger is raised, the lower one moves upward to eject the pellet.

The extruder, in which the pasty mixture is forced through an orifice, the feeder, using a system of screws turning in a sleeve, which may be heated.

In the case of pressurized agglomeration, and whatever the nature of the binding agent used, the binding agent/carbide mixture must be prepared before it is placed in the agglomeration apparatus, i.e., mixture or grinder.

The choice between the two groups of agglomeration techniques is motivated by both technical and economic considerations:

From a technical standpoint, the advantages lie with pressurized agglomeration machines, since products which are agglomerated under pressure exhibit better mechanical strength. Furthermore, roll presses and tableting press produce perfectly-sized products.

From an economic perspective, the situation is more qualified. The cost of operating pressurized equipment is lower, but their capital cost is substantially higher than the cost of non-pressurized apparatuses.

Second Grinding of the Agglomerated Product

The balls, pellets, or extruded products obtained during the agglomeration operation are often coarser than the granulometry desired for the desulfurizing agent. It consequently becomes necessary to undertake a second grinding operation, normally cursory in nature, followed by a sifting operation, to reduce them to this granulometry. After sifting, the excessively-fine particles are recycled to the agglomeration step, and the excessively-coarse particles are recycled to the top of the grinder.

It may prove advantageous, moreover, to further improve pourability of the desulfurizing agent obtained, by adding to the reground, sifted desulfurizing agent a very small quantity, i.e., approximately 1%, of carbon black and mixing it thoroughly with the desulfurizing agent.

EXAMPLES

Examples 1, 2, 3, 4, and 5 exemplify the mixture by mixing calcium carbide with various binding agents.

Example 1

A) A rod mill was used to grind, under identical operating conditions and at the same temperature of 115° C., two batches of calcium carbide from the same source, one with the addition of 1% hydrogenated castor oil and the other without it.

A granulometric analysis was performed on each of these two batches, giving the following results:

| Mesh (μm) | Without hydrogenated castor oil | | With hydrogenated castor oil | |
|---|---|---|---|---|
| | Rejects | Cumulative Rejects | Rejects | Cumulative Rejects |
| 100 | 11.2 | 11.2 | 5.6 | 5.6 |
| 75 | 11.6 | 22.8 | 10.1 | 15.7 |
| 50 | 19.6 | 42.4 | 24.5 | 40.2 |
| 25 | 31.7 | 74.1 | 46.4 | 86.7 |
| undersize | 25.6 | | 13.3 | |

On each line in succession for the batch without hydrogenated castor oil and for the batch containing it, this table gives, in the first column, the sizes in micrometers of the square mesh sieve; in the following column, the fraction (in %) which is bigger than the corresponding mesh but finer than the preceding mesh; and, in the next column, the cumulative value (in %) of the fractions bigger than the corresponding mesh.

This table shows that:

granulometry is smaller using the product according to the invention. There are fewer coarse particles (greater than 100 micrometers), i.e., 5.6% instead of 11.2%; and, above all, there are approximately one-half fewer fines (less than 25 micrometers), i.e., 13.3% instead of 25.6%.

nevertheless, the proportion of particles having a diameter greater than 50 micrometers remains substantially the same, i.e., approximately 50%.

B) A cursory flow test was conducted to to compare the pourability of the two powders. This test consists in passing a powder sample through a sized opening located on eh bottom of a funnel whose half-angle at the vertex is 20°. Under well-defined conditions for filling the funnel, the result is expressed as the lowest diameter of the opening for which flow is observed.

As regards carbide powder without hydrogenated castor oil, flow was observed for a diameter of 22 mm, while, in the case of ground powder to which hydrogenated castor oil was added, flow was observed for a diameter of 18 mm.

C) The explosion thresholds of the carbide powder were measured comparatively with and without the addition of hydrogenated castor oil. Tests were conducted by causing a known energy spark to explode within a cloud of the dust of the product (grains were less than 50 micrometers) in suspension in a vertical cylinder traversed by an ascending current of supporting gas, oxygen, or air. The sparks were generated by the discharge of capacitors preliminarily charged under direct 260-volt current. The flow rate of the gas was 6 liters per minute, and the quantity of powder, 2 grams. The energy of the spark is given by the formula:

$$E=\tfrac{1}{2}CV^2,$$

where C is the capacity of the capacitor, and V, the voltage.

A series of 20 consecutive tests were then conducted. The explosivity threshold is defined as the minimum energy above which the explosion probability is>5% (1 explosion for every series of 20 tests). The higher the explosivity threshold, the less explosive the powder.

Using the carbide powder without additive, the explosivity threshold was 31 mJ (millioule). Using the powder according to the invention, the threshold was raised to 213 mJ.

D) To evaluate reactivity to water, 2 g of each of the powders were placed in 30 milliliters of water. The volume of acetylene released per second was measured. Using the carbide without additive, a release of 70 ml/s was observed, while, with the powder according to the invention, this release was only 11 ml/s.

The desulfurization efficacy of three mixtures was compared:

mixture (1) according to prior art and composed of:

technical calcium carbide: 93% carbon-containing products (coal, carbon black): 7%.

a mixture (2) according to the invention and composed of:

technical calcium carbide: 93% carbon-containing products: 6% hydrogenated castor oil 1%.

a mixture (3) according to the invention and composed of:

technical calcium carbide: 99% hydrogenated oil of ricin: 1%.

Three batches of a single cast iron having an initial sulfur content $S_i$=0.050% were treated using a proportion of 3 kg of desulfurizing agent per ton of cast iron. The table below indicates, for each of the desulfurizing agents, the final sulfur content $S_f$ reached and the rate of desulfurization T, which is defined as the relation $(S_i-S_f)/S_i$.

| Mixture | $S_f$ | T |
|---|---|---|
| 1 | 0.018% | 64% |
| 2 | 0.013% | 74% |
| 3 | 0.012% | 76% |

These tests make it possible to ascertain the improvement in the efficacy of the desulfurization mixture according to the invention, as compared with the other mixtures.

EXAMPLE 2

Mixture obtained by mixing calcium carbide with a furfurylic resin.

The test began with micronized calcium carbide, to which coal was added in the proportion of 7%. The mixture had the following granulometry:

| Mesh (μm) | Rejection (%) | Cumulative Rejection |
|---|---|---|
| 200 | 10 | 10 |
| 100 | 28 | 38 |
| 75 | 7 | 45 |
| 50 | 14 | 59 |
| 25 | 16 | 75 |
| undersize | 25 | |

This carbide, to which coal was added, was mixed for 10 minutes in a mixer with a furfurylic resin in a proportion of 10% of the weight of the carbide, first at ambient temperature and then at 100° C. in order to cause hardening of the resin.

Granulometric analysis of the product obtained was as follows:

| Mesh (μm) | Rejection (%) | Cumulative Rejection (%) |
|---|---|---|
| 200 | 12 | 12 |
| 100 | 34 | 46 |
| 75 | 12 | 58 |
| 50 | 22 | 80 |
| 25 | 16.5 | 96.5 |
| undersize | 3.5 | |

It was determined that the granulometry progressed toward coarser grain sizes, since the figures in the last column are higher than in the starting product, and, in particular, because fines of less than 25 μm then accounted for only 3.5%, instead of 25%.

EXAMPLE 3

Mixture obtained by mixing calcium carbide with hydrogenated castor oil (Ricidrol).

The starting product was micronized calcium carbide having the same granulometry and the same quantity of coal as in the preceding example.

The Ricidrol, present in the proportion of 5% of the weight of the carbide, was poured in liquid form into the mixer containing the calcium carbide heated to 100° C. The mixture was forcefully stirred for 10 minutes, then cooled while agitation continued.

The granulometric analysis performed on the product obtained was as follows:

| Mesh (μm) | Rejection (%) | Cumulative Rejection (%) |
|---|---|---|
| 200 | 11 | 11 |
| 100 | 33 | 44 |
| 75 | 11 | 55 |
| 50 | 19 | 74 |
| 25 | 21.5 | 95.5 |
| undersize | 4.5 | |

In this case also, the granulometry progressed toward coarser grain sizes; in particular, fines of less than 25 μm then accounted for only 4.5%, instead of 25%. Nevertheless, the granulometry was somewhat finer than with furfurylic resin.

EXAMPLE 4

Mixture obtained by mixing calcium carbide, to which coal was added, with hydrogenated castor oil (Ricidrol).

The conditions for preparation of the mixture were the same as those in Example 3, but, in this instance, a quantity of hydrogenated castor oil (Ricidrol) equal to 10% of the weight of the carbide was used.

Granulometric analysis of the product obtained was as follows:

| Mesh (μm) | Rejection (%) | Cumulative Rejection (%) |
|---|---|---|
| 200 | 38.5 | 38.5 |
| 100 | 29 | 67.5 |
| 75 | 9 | 76.5 |
| 50 | 14 | 90.5 |
| 25 | 8 | 98.5 |
| undersize | 1.5 | |

In this example, once again, the granulometry progressed toward coarser grain sizes and, in particular, fines of less than 25 μm then accounted for only 1.5%, instead of 25%. The granulometry was, in any case, substantially coarser than that obtained with furfurylic resin or with 5% Ricidrol alone.

EXAMPLE 5

Mixture obtained by mixing calcium carbide with stearic acid (Stearin).

The conditions for preparation of the mixture were the same as those in Example 3. However, use was made, in this instance, of stearic acid, or stearin, in a proportion of 10% of the weight of the carbide.

Granulometric analysis of the product obtained was as follows:

| Mesh (μm) | Rejection (%) | Cumulative Rejection (%) |
|---|---|---|
| 200 | 44 | 44 |
| 100 | 45 | 89 |
| 75 | 5.5 | 94.5 |
| 50 | 4 | 98.5 |
| 25 | 1 | 99.5 |
| undersize | 0.5 | |

Here again, granulometry progressed toward still much coarser grain sizes, and, in particular, fines of less than 25 μm then accounted for only 05%, instead of 25%. Granulometry was, in any case, substantially coarser than that obtained with furfurylic resin or with 5%, or even 10%, Ricidrol.

The five examples described above show that a simple mixture of calcium carbide with a suitable binding agent in a mixer by itself makes possible an increase in the number of coarse particles and a reduction in the number of fine particles. Nevertheless, in the best of cases, i.e., that in Example 5, the product obtained contains only 44% particles whose diameter is greater than 200 μm.

FIG. 1 gives, in another, more synthetic form, granulometries of the starting product and of the mixtures corresponding to Examples 2 to 5. This figure shows, along the ordinate, the cumulative percentages of the grains smaller than the sizes indicated along the abscissa.

The following examples show that a combination of a mixing and a agglomeration operation makes it possible to increase granulometry significantly.

EXAMPLE 6

Agglomeration by Pelletizing

A mixture of calcium carbide and coal having the granulometry indicated in Example 2, and to which 5% stearic acid was added, was prepared in a mixer. The temperature in the mixer was adjusted to approximately 100° C., in order to preserve the stearic acid in liquid form.

The result was a product composed of stearin-coated carbide whose granulometry was intermediate between those of the products in Examples 3 and 5. After cooling, this product was placed in the feed hopper of a tableting press, whose pressure was adjusted to 7 bars. The product was shaped into small cylinders 10 mm in diameter and 6 mm in height and having a weight of approximately 1 g. These pellets then underwent a second careful grinding in a hammer mill. All of the grains thus produced were smaller than 6 mm, and 64% of them ranged between 0.3 and 6 mm. Grains<0.3 mm were recycled in the mixer.

EXAMPLE 7

Agglomeration in the Cylinder Press

A mixture of calcium carbide having the granulometry specified in Example 2 and to which 10% stearic acid was added was prepared in mixer. The temperature in the mixer was kept at approximately 100° C. to ensure that the stearic acid would remain in the liquid state.

The result was a product composed of stearin-coated carbide having a granulometry analogous to that of the products in Example 5. At a temperature of between 80° C. and 100° C. (since cooling was not required in this case), the product was placed in the feed hopper of an roll press. During the different tests, the gap between the cylinders varied between 0.5 and 5 mm. Accordingly, the final product was obtained in the form of small wafers measuring several centimeters on a side and from 0.5 to 5 mm in thickness. These wavers then underwent a second careful grinding operation in a hammer mill. Grains were produced approximately 60% of which were between 0.3 and 6 mm. The grains <0.3 mm were recycled to the mixer, while the grains >6 mm wre recycled in the hammer mill.

EXAMPLE 8

Agglomeration Using the Roll Press

A mixture of calcium carbide having a granulometry of between 9 and 12 mm, to which 5% stearic acid was added, was prepared in a mixer. The mixer was kept at ambient temperature.

The mixture obtained was placed in the feed hopper of a roll press, whose cylinders incorporate ovoid-shaped cavities. In the upper part, where the two press cylinders are close together, the press functions like a grinder in which carbide grains are reduced. The crushed gains were agglomerated in proximity to the plane containing the axes of the cylinders, by means of binding agent formed into an ovoid shape. These ovoids then underwent a second careful grinding operation in a hammer mill. Grains were produced, approximately 60% of which were between 0.3 and 10 mm. The grains <0.3 mm were recycled to the mixer, while the grains>10 mm were recycled in the hammer mill.

EXAMPLE 9

Four batches of a single cast iron were treated in parallel, on the one hand with a desulfurizing agent according to the invention and prepared under the conditions in Example 7, and, on the other, with a desulfurizing agent according to prior art and composed of coarsely-ground technical calcium carbide containing approximately 10% lime, so that the size of the grains was between 0.3 and 4 mm. The quantities of desulfurizing agent used were 3.5 kg/ton for the desulfurizing agent according to the invention (Test No. 1) and 3.5, 10, and 20 kg/ton for the desulfurizing agent according to prior art (Tests Nos. 2, 3, 4). The results obtained are reported in the table below, in which the beginning $S_i$ and ending $S_f$ sulfur contents are expressed as percentages, as is the desulfurization rate T, which equals the relation $(S_i-S_f)/S_i$:

| Test No. | 1 | 2 | 3 | 4 |
|---|---|---|---|---|
| Initial sulfur | 0.05 | 0.05 | 0.05 | 0.05 |
| Final sulfur | 0.013 | 0.032 | 0.02 | 0.012 |
| Rate T: | 74 | 36 | 60 | 76 |

It will be seen that the use of the agglomerated calcium carbide-based desulfurizing agent according to the invention produces a desulfurization efficacy nearly equivalent to that of a quantity five times higher of carbide containing grains of 0.3 to 4 mm.

We claim:

1. Calcium carbide-based product for desulfurization of liquid cast iron consisting of grains composed of calcium carbide powder which is coated or agglomerated by means of a binding agent selected from the group consisting of an organic product having a melting point of between 70° C. and 100° C. and a polymer resin whose polymerization temperature is between 40° C. and 70° C.

2. Cast iron-desulfurization product according to claim 1, wherein said grains are coated with a first layer of a binding agent and a substantially continuous second layer made of finer coated calcium carbide powder.

3. Cast iron-desulfurization produce of claim 1, wherein the carbide powder is micronized powder in which the rain diameter is between several micrometers and 25 micrometers.

4. Cast iron-desulfurization product according to claim 1, wherein the binding agent is pitch selected from the group consisting of pitch stearic acid and a saturated fatty glycerol ester.

5. Cast iron-desulfurization product according to claims 1, wherein the binding agent is a saturated fatty ester having a chemical purity of at least 90%.

6. Cast iron-desulfurization according to claim 5, wherein the binding agent is hydrogenated castor oil based on glycerol trihydroxystearate.

7. Cast iron-desulfurization product according to claim 1, wherein the binding agent is selected from the group consisting of furfurylic, polyester, vinyl-ester and epoxy reins.

8. Cast iron-desulfurization product according to claim 1 wherein the quantity of binding agent is between 0.2 and 10% of the weight of the carbide.

9. Cast iron desulfurization product according to claim 1, wherein the calcium carbide is supplemented with a carbon-containing product selected form the group consisting of coal, anthracite and oil coke, in a proportion of from 4 to 10% of the weight of the carbide.

10. Cast iron-desulfurization product according to claim 1, wherein the calcium carbide is supplemented with at least one product selected from the group consisting of lime, calcium carbonate, lime diamide, magnesia and alumna, in a total proportion which may reach 100% of the weight of the carbide.

11. Cast iron-desulfurization product according to claim 1, wherein 85% of its grains are between 25 and 300 micrometers.

12. Cast iron-desulfurization product according to claim 1, wherein the grains have a diameter of between 0.3 and 10 mm.

13. Cast iron-desulfurization product according to claim 1, wherein the agglomerated calcium carbide grains are mixed with approximately 1% carbon block.

14. Process for manufacture of a cast iron-desulfurization product essentially containing calidum carbide, comprising the step of preparing a homogeneous mixture of calcium carbide and a binding gent selected from the group consisting of an organic product having a melting point of between 70° and 100° C. and a polymer resin having a polymerization temperature between 40° and 70° C.

15. Process for manufacture of a cast iron-desulfurization product according of claim 14, wherein micronized calcium carbide and a binding agent composed of an organic product having a melting point of between 70° and 10° C. are mixed at a temperature higher than the melting point of the binding agent.

16. Process for manufacture of a cast iron-desulfurization product according to claim 15, wherein calcium carbide and the binding agent are mixed in a carbid-micrionization grinding machine, at the entry to which e binding agent is added.

17. Process for manufacture of a cast iron-desulfurization product according to claim 14, wherein the quantity of binding agent mixed with the carbide is between 0.2 and 10% of the weight of the carbide.

18. Process for manufacture of a cast iron-desulfurization product according to claim 15, wherein a carbon-containing product is added to the calcium carbide-binding agent mixture in a proportion of from 4 to 10% of the weight of the carbide, either in the grinder or at the it of the grinder.

19. Process for manufacture of a cast iron-desulfurization product according to claim 15, wherein the binding agent used is an organic agent having clear-cut melting point between 70° and 100°, and wherein the mixing operations are conducted at a temperature higher than said melting point, and wherein the homogeneous mixture obtains is then agglomerated and shaped using an apparatus selected form the group consisting of granulating drums, inclined pans, drum agglomerators, roll presses, tableting presses, and extruder.

20. Process for manufacture of a cast iron-desulfurization product according of claim 14, wherein the binding agent used in an organic resin which can be polymerized at a temperature between 40° and 70°, and wherein the mixing operations are conducted at substantially ambient temperature, wherein the homogeneous mixture obtained is then agglomerated and shaped using an apparatus selected from the group consisting of inclined pans, drum agglomerators, roll presses, tableting presses and extruders, and wherein the resin is polymerized.

21. Process or manufacture of a cast iron-desulfurization product according to claim 19, wherein the homogenous agglomerated and shaped mixture is then ground and sifted so as to import to it the desired granulometry.

22. Process for manufacture of a cast iron-desulfurization product according to claim 14, wherein the binding agent is selected from the group consisting of pitch, stearic acid and a saturated fatty glycerol ester.

23. Process for manufacture of a cast iron-desulfurization product according to claim 22, wherein the binding agent is hydrogenated castor oil based on glycerol trihydroxystearate.

24. Process for manufacture for a cast iron-desulfurization product according to claim 14, wherein the binding gent is a resin selected form the group consisting of furfurylic, polyester, vinyl easter and epoxy reins.

25. Process for manufacture of a cast iron-desulfurization product according to claim 19, wherein the mixture of calcium carbide, binding agent and, potentially, a carbon-containing product is prepared in the agglomeration apparatus.

26. Process for manufacture of a cast iron-desulfurization product according to claim 14, wherein the calcium carbide has a granulometry of between 0 and 12 mm and is ground and mixed with the solid binding agent in a roll press at ambient temperature.

27. Process for manufacture of a cast iron-desulfurization product according to claim 14, wherein the agglomerated, reground, and sifted product is mixed with carbon black in a proportion of approximately 1% of its weight.

28. Cast iron-desulfurization product according of claim 1, wherein the calcium carbide is supplemented with at least one product selected from the group consisting of carbon black, aluminum, magnesium and calcium.

* * * * *

UNITED STATES PATENT AND TRADEMARK OFFICE

CERTIFICATE OF CORRECTION

PATENT NO. : 5,242,480

DATED : September 7, 1993

INVENTOR(S) : Rebiere et al

It is certified that error appears in the above-identified patent and that said Letters Patent is hereby corrected as shown below:

Column 12:

In claim 9, line 56, change "form" to --from--.

Column 13:

In claim 14, line 10, change "gent" to --agent--.

In claim 16, line 24, change "carbid" to --carbide--; on line 25, delete "e" at the end of the sentence in favor of --the--.

In claim 18, line 36, delete "it" in favor of --exit--.

In claim 19, line 40, before "clear" insert --a--; on line 44, change "obtains" to --obtained--.

Column 14:

In claim 20, line 2, change "of" to --to--; on line 3, change "in" to --is--.

Signed and Sealed this

Tenth Day of May, 1994

Bruce Lehman

*Attest:*

BRUCE LEHMAN

*Attesting Officer*

*Commissioner of Patents and Trademarks*